US005209189A

United States Patent [19]

Weitzenbuerger et al.

[11] Patent Number: 5,209,189

[45] Date of Patent: May 11, 1993

[54] INTERNAL-COMBUSTION ENGINE

[75] Inventors: Hans Weitzenbuerger; Dieter Esche; Albert Nolte, all of Cologne; Michael Klocke, Solingen, all of Fed. Rep. of Germany

[73] Assignee: Kloeckner-Humboldt-Deutz AG, Cologne, Fed. Rep. of Germany

[21] Appl. No.: 675,073

[22] Filed: Mar. 25, 1991

[30] Foreign Application Priority Data

Mar. 29, 1990 [DE] Fed. Rep. of Germany ..... 4010087

[51] Int. Cl.[5] ..... F01P 7/10

[52] U.S. Cl. ..... 123/41.49; 123/41.82 R

[58] Field of Search ..... 123/41.11, 41.48, 41.49, 123/41.82 A

[56] References Cited

U.S. PATENT DOCUMENTS 4,131,093 12/1978 Mansfield ..... 123/41.82 R
4,508,066 4/1985 Hartsock ..... 123/49.82 A
4,846,258 7/1989 Charles ..... 123/41.49

FOREIGN PATENT DOCUMENTS 1194202 6/1965 Fed. Rep. of Germany .

*Primary Examiner*—Noah P. Kamen

[57] ABSTRACT

A reciprocating internal combustion engine whose thermally loaded components are cooled by a cooling liquid. The internal combustion engine has at least one cylinder with piston and a cylinder head associated therewith having an exhaust duct, as well as at least one liquid/air heat exchanger, which receives cooling-air from a cooling fan.

The cooling fan (2) has a diffuser (3) and the liquid/air heat exchanger (1) is adapted to operate at an elevated cooling-air pressure of the cooling fan (2). The pressure of the cooling-liquid system and/or the composition of the cooling liquid are selected such that the boiling point of the cooling liquid lies between 110° and 130° C., preferably around 125° C. The exhaust duct (5) in the cylinder head (4) is substantially thermally isolated from nearby regions of the cylinder head.

4 Claims, 1 Drawing Sheet

FIG.1
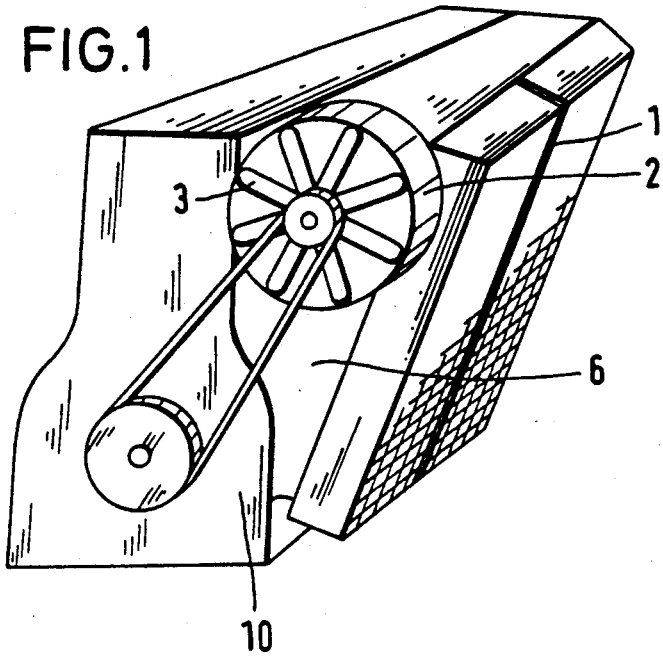
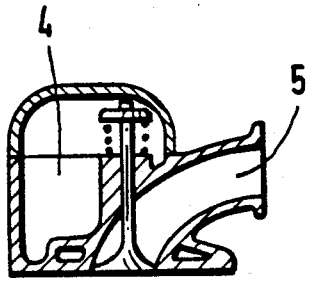
FIG.3
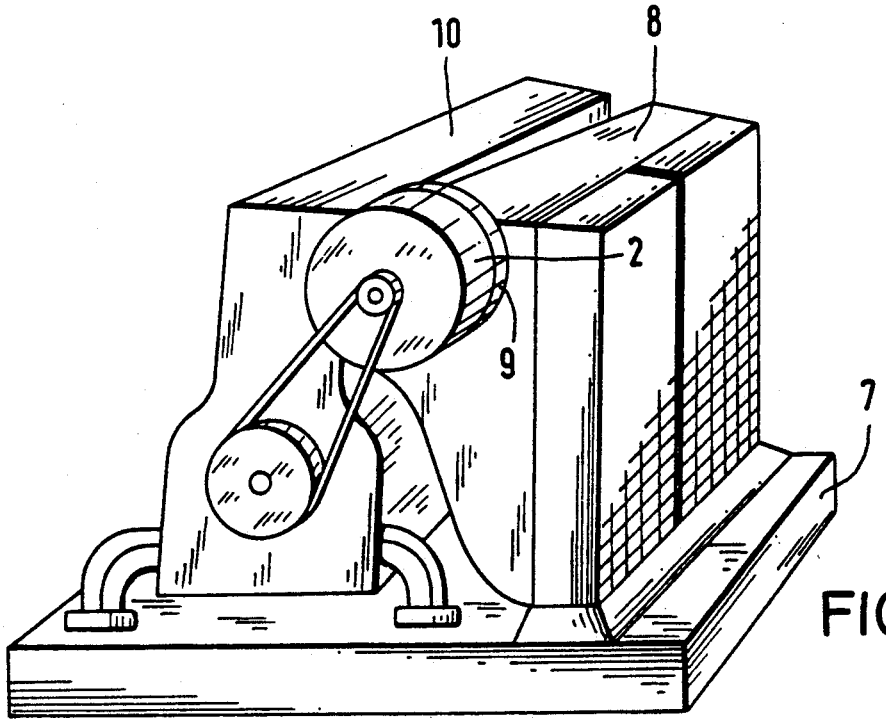
FIG.2

INTERNAL-COMBUSTION ENGINE

TECHNICAL FIELD

This invention related to a cooling system of a reciprocating internal combustion engine.

PRIOR ART STATEMENT

A liquid cooled internal combustion engine ordinarily has a liquid/air heat exchanger or radiator positioned at its front end and has an engine fan delivering cooling air to the heat exchanger. The internal combustion engine and liquid/air heat exchanger are separately supported on a vehicle chassis or on a stationary frame. As the power output of the internal combustion engine increases in relation to its size, the liquid/air heat exchanger takes up an increasing portion of the space available for the power unit making placement in vehicles increasingly difficult. The space problems are further aggravated when hydraulic equipment, whose cooling demand can be as high as 50% of the cooling demand of the internal combustion engine, is employed.

A reciprocating internal combustion engine is described in DE-AS [German Examined Application] 11 94 202, of which engine the cylinders are arranged in line and the liquid/air heat exchanger is attached laterally beside the reciprocating internal-combustion engine. A cooling-air fan driven by the reciprocating internal-combustion engine delivers the cooling air into a cooling-air plenum between the reciprocating internal-combustion engine and the liquid/air heat exchanger.

This reciprocating internal-combustion engine is, however, a naturally aspired motor operating under relatively low load, whose liquid/air heat exchanger, despite the small amount of heat removed, occupies the entire length of the motor. In modern motors, which are heavily loaded and compact, in particular supercharged motors, it is difficult to position the liquid/air heat exchanger in the fashion described, especially if space must additionally be made available for a high-capacity outboard oil cooler of cooling systems of mechanical, hydrostatic and hydrodynamic transmissions or retarders.

OBJECTS AND BRIEF SUMMARY OF THE INVENTION

It is an object of the invention to create a cooling system for liquid-cooled internal-combustion engines which is compact and easy to install.

In this invention the cooling fan with diffuser, in contrast to the conventional diffuserless fans of liquid-cooled engines, sets up an elevated pressure of cooling air. This increased pressure makes it possible to increase the structural depth of the liquid/air heat exchanger or to increase the cooling-air-side flow resistance of said liquid/air heat exchanger by means of high-efficiency cooling fins. By this means, the cooling air absorbs more heat and is thus better utilized. This results in a smaller cooling-air flow requirement and thus to a smaller structural size of the liquid/air heat exchanger. In cooling systems using this invention, the temperature difference between the cooling medium and the ambient air is increased, by the heating of the cooling air is increased and the dimensions of the liquid/air heat exchanger are reduced. Furthermore, by reducing cooled surface areas, the amount of heat removed is diminished and thus a further decrease in the size of the liquid/air heat exchanger is achieved.

In one embodiment of the invention, a compact liquid/air heat exchanger of an engine cooling system is not integral with the engine. This allows flexibility in cooling system arrangements and attendant fan drives thus permitting the optimum cooling system for each set of installation conditions in vehicles or machinery.

In another embodiment of the invention the cooling fan is directly driven by the engine and thus contributing to a compact engine/heat-exchanger unit.

In other embodiments of the invention the cooling fan is provided with a diffuser. A front pressure difusser has the advantage of protecting the rotor of the cooling fan against contact, while a rear-diffuser suction fan is distinguished by particularly low noise emissions and, because the spacing between the rear difusser and the crankcase housing, cylinder and cylinder head may be very small, permits a shorter axial structural length of the rotor. The design as a pressure fan has the advantage of a low fan power consumption, since the cooling fan delivers unheated cooling air. On the other hand, the suction fan offers the advantage of a uniform flow of cooling air over the heat exchanger and easy conveyance of the warm discharge air.

Liquid/air heat exchangers of this invention may be positioned in a particularly space-saving manner and permit an advantageous withdrawal of the warm cooling air. It may be advantageous to locate the liquid/air heat exchanger or exchangers separately from the engine and thus protected from its vibrations. The connection between the cooling-air fan attached to the engine and the air-guiding scoop is advantageously designed in such a fashion that relative movement between the liquid/air heat exchanger and the fan or motor is possible.

An advantageous development of the invention effects a particularly compact design of the unit consisting of motor and liquid/air heat exchanger. In this solution, all hose connections between the exchanger or exchangers and the motor are omitted. This offers the advantage of increased ease of installation and system reliability.

When producing a large number of units, it is advantageous to fabricate the liquid/air heat exchangers from individual components. If, however, engines with various capacities are required, each in a small number of units, it is advantageous to assemble the individual heat exchangers in modular fashion. This can be accomplished by means of parallel connection and by means of series connection of the individual cooler elements. In this fashion, a great variety of models is made possible with few structural modules.

This invention is particularly adapted to accommodate closedcircuit cooling of cooling liquid and working fluid, as occur particularly in equipment with hydrodynamic or hydrostatic transmissions or with retarders. The compact unit of this invention accommodates withdrawing not only the waste heat of the engine but also the waste heat of auxiliary equipment.

BRIEF DESCRIPTION OF THE DRAWINGS

Further features of the invention can be derived from the following description and the drawing, in which an exemplary embodiment of the invention is illustrated.

FIG. 1 shows a perspective view of the compact engine-cooler unit with liquid/air heat exchanger attached to the engine.

FIG. 2 shows a perspective view of a compact engine-cooler unit with supporting device for the separate supporting of the engine and the liquid/air heat exchanger.

FIG. 3 shows a schematic representation of a cylinder head with a largely uncooled exhaust duct.

DETAILED DESCRIPTION OF THE DRAWINGS

Referring to FIG. 1, a cooling fan 2 with a diffuser in the form of a bladed impeller, a liquid/air heat exchanger 1, and a cooling-air plenum 6 are mounted on an internal combustion engine 10. FIG. 2 shows the reciprocating internal combustion engine 10 and the liquid/air heat exchanger 1 mounted individually on a supporting platform and shows the cooling fan and a scoop 8 interconnected by a flexible elastic boot 9. The very compact design of the units can be seen in both figures, and further the complete absence of hose connections between motor and heat exchanger can be seen in the arrangement of FIG. 1.

In FIG. 3, the small cooled area of the exhaust duct 5 of the cylinder head 4 is illustrated. This effects a marked decrease in the amount of heat removed from the motor and thus permits a decrease in the size of the liquid/air heat exchanger.

The illustrated liquid cooled reciprocating internal combustion engine has a plurality of in-line cylinders with pistons and a cylinder head (4. It also has a cooling-liquid system including a cooling liquid of predetermined composition wherein the boiling point of the cooling liquid lies between 100° C. and 130° C. A cooling fan (2) having a diffuser (3) provided which is operable to deliver cooling air at an elevated pressure, as shown in FIG. 2, a liquid/air heat exchanger (1) is mounted on a supporting platform (7) in juxtaposed relation to the engine but separately supported on the platform. A scoop (8) and a flexible elastic boot (9) interconnect the cooling air fan (2) and the liquid/air heat exchanger (1) whereby the latter is supplied cooling air. The exhaust duct as illustrated in FIG. 3 has a substantial portion which projects outwardly so it is thermally isolated from nearby regions of the cylinder head.

We claim:

1. In a liquid cooled reciprocating internal combustion engine having at least one cylinder with a piston and a cylinder head (4) the combination comprising:

a supporting platform mounting said engine, a cooling-liquid system including a cooling liquid of predetermined composition wherein the boiling point of the cooling liquid lies between 110° C. and 130° C., a cooling fan (2) having a diffuser (3) operable to deliver cooling air at an elevated pressure, a liquid/air heat exchanger (1) mounted on said platform separately of said engine, a scoop (8) and a flexible elastic boot (9) interconnected between said cooling air fan (2) and said liquid/air heat exchanger (1) whereby the latter is supplied cooling air at an elevated pressure from said cooling fan (2); and an exhaust duct (5) in said cylinder head (4) having a substantial portion which projects outwardly so it is thermally isolated from nearby regions of the cylinder head.

2. The internal combustion engine of claim 1 wherein said cooling fan (2) is mounted in a fixed position on the internal combustion engine.

3. The internal combustion engine of claim 1 wherein said cooling fan (2) is a pressure fan pushing air through said liquid/air heat exchanger (1).

4. The internal combustion engine of claim 1 wherein internal combustion has a plurality of in-line cylinders and said liquid/air heat exchanger (1) is spaced in juxtaposed relation to said internal combustion engine.

* * * * *

UNITED STATES PATENT AND TRADEMARK OFFICE

CERTIFICATE OF CORRECTION

PATENT NO. : 5,209,189

DATED : May 11, 1993

INVENTOR(S) : Hans Weitzenbuerger, Dieter Esche, Albert Nolte, Michael Klocke

It is certified that error appears in the above-identified patent and that said Letters Patent is hereby corrected as shown below:

Column 4, line 35, after "wherein" insert --- said ---;

Column 4, line 36, after "combustion" insert --- engine ---.

Signed and Sealed this

Twenty-second Day of March, 1994

*Attest:*

Bruce Lehman

BRUCE LEHMAN

*Attesting Officer*

*Commissioner of Patents and Trademarks*